US006664932B2

(12) United States Patent
Sabet et al.

(10) Patent No.: US 6,664,932 B2
(45) Date of Patent: Dec. 16, 2003

(54) MULTIFUNCTION ANTENNA FOR WIRELESS AND TELEMATIC APPLICATIONS

(75) Inventors: Kazem F. Sabet, Ann Arbor, MI (US); Kamal Sarabandi, Ann Arbor, MI (US); Linda P. B. Katehi, Northville, MI (US); Panayiotis Frantzis, Ann Arbor, MI (US)

(73) Assignee: EMAG Technologies, Inc., Ann Arbor, MI (US)

( * ) Notice: Subject to any disclaimer, the term of this patent is extended or adjusted under 35 U.S.C. 154(b) by 0 days.

(21) Appl. No.: 10/084,576

(22) Filed: Feb. 27, 2002

(65) Prior Publication Data

US 2002/0175879 A1 Nov. 28, 2002

Related U.S. Application Data

(63) Continuation-in-part of application No. 09/758,955, filed on Jan. 11, 2001, now Pat. No. 6,480,162.
(60) Provisional application No. 60/175,790, filed on Jan. 12, 2000.

(51) Int. Cl.[7] ..... H01Q 13/10; H01Q 1/24; H01Q 1/38

(52) U.S. Cl. ..... 343/770; 343/765; 343/700 MS

(58) Field of Search ..... 343/770, 700 MS, 343/767, 826, 765, 737, 742, 776, 810, 702, 893, 769, 725; H01Q 1/24, 13/10, 1/38

(56) References Cited

U.S. PATENT DOCUMENTS

| | | | | |
|---|---|---|---|---|
| 3,031,665 A | | 4/1962 | Robert-Pierre Marie | 343/770 |
| 3,638,226 A | | 1/1972 | Brooks et al. | 343/895 |
| 4,313,120 A | | 1/1982 | Westerman | 343/771 |
| 4,672,386 A | | 6/1987 | Wood | 343/770 |
| 4,839,663 A | | 6/1989 | Kurtz | 343/741 |
| 4,853,704 A | * | 8/1989 | Diaz et al. | 343/767 |
| 5,068,670 A | | 11/1991 | Maoz | 343/767 |
| 5,087,922 A | | 2/1992 | Tang et al. | 343/814 |
| 5,155,493 A | | 10/1992 | Thursby et al. | 343/700 MS |
| 5,194,876 A | | 3/1993 | Schnetzer et al. | 343/769 |
| 5,353,035 A | | 10/1994 | Del Castillo Cuervo-Arango et al. | 343/700 MS |
| 5,489,913 A | * | 2/1996 | Raguenet et al. | 343/767 |
| 5,530,358 A | | 6/1996 | Wisler et al. | 324/338 |
| 5,539,362 A | * | 7/1996 | Culling | 333/116 |
| 5,539,420 A | | 7/1996 | Dusseux et al. | 343/769 |
| 5,661,493 A | * | 8/1997 | Uher et al. | 343/700 MS |
| 5,706,015 A | | 1/1998 | Chen et al. | 343/700 MS |
| 5,714,961 A | * | 2/1998 | Kot et al. | 343/700 MS |
| 5,808,586 A | | 9/1998 | Phillips et al. | 343/895 |
| 5,892,480 A | | 4/1999 | Killen | 343/385 |
| 5,914,693 A | | 6/1999 | Takei et al. | 343/767 |
| 5,929,825 A | | 7/1999 | Niu et al. | 343/895 |
| 6,023,214 A | | 2/2000 | Ohta et al. | 336/84 R |

(List continued on next page.)

*Primary Examiner*—Don Wong
*Assistant Examiner*—Trinh Vo Dinh
(74) *Attorney, Agent, or Firm*—John A. Miller; Warn, Burgess & Hoffmann, P.C.

(57) ABSTRACT

A multifunction printed antenna for wireless and telematic applications. In one embodiment, GPS and satellite radio patch antenna elements are printed on one side of a printed circuit board and AMPS, PCS, GSM and terrestrial radio slot antenna elements are etched in a ground plane on an opposite side of the same printed circuit board. In an alternate embodiment, the GPS and satellite radio patch antenna elements are elements mounted on one printed circuit board and the AMPS, GSM, PCS and terrestrial radio slot antenna elements are etched in a ground plane on another printed circuit board rigidly secured orthogonal to the GPS and satellite printed circuit board. The AMPS, GSM and PCS circuit board can be curved to reduce the nulls at the edges of the circuit board. Further, the edge of the AMPS, GSM and PCS circuit board that contacts the GPS and satellite radio circuit board can have a saw-tooth pattern so that edge currents are reduced.

37 Claims, 13 Drawing Sheets

U.S. PATENT DOCUMENTS 6,031,491 A * 2/2000 Daniel et al. ..... 343/700 MS
6,081,239 A 6/2000 Sabet et al. ..... 343/753
6,104,349 A * 8/2000 Cohen ..... 343/702
6,137,444 A * 10/2000 Pettersson et al. ... 343/700 MS
6,160,514 A * 12/2000 Judd ..... 343/700 MS
6,225,950 B1 * 5/2001 Johansson et al. ... 343/700 MS
6,288,677 B1 * 9/2001 Fink ..... 343/700 MS
6,317,101 B1 * 11/2001 Dockery ..... 343/765
6,326,922 B1 * 12/2001 Hegendoerfer ..... 343/700 MS
6,342,869 B1 * 1/2002 Edvardsson et al. ..... 343/702
6,452,560 B2 * 9/2002 Kunysz ..... 343/769
6,480,162 B2 * 11/2002 Sabet et al. ..... 343/767

* cited by examiner

MULTIFUNCTION ANTENNA FOR WIRELESS AND TELEMATIC APPLICATIONS

CROSS REFERENCE TO RELATED APPLICATIONS

This application is a Continuation-in-Part Application of U.S. patent application Ser. No. 09/758,955, titled Low Cost Compact Omni-Directional Printed Antenna, filed Jan. 11, 2001 now U.S. Pat. No. 6,480,162, which claims the benefit of U.S. Provisional Application No. 60/175,790, titled Low Cost Compact Omni-Directional Printed Antenna, filed Jan. 12, 2000.

BACKGROUND OF THE INVENTION

1. Field of the Invention

This invention relates generally to a multifunction printed antenna and, more particularly, to a multifunction printed antenna for wireless and telematic applications, including GPS, satellite radio, AMPS, PCS, GSM, etc., where multiple antenna elements are printed on a common circuit board.

2. Discussion of the Related Art

There is a growing demand for wireless communications services, such as cellular telephone, personal communications systems (PCS), global positioning systems (GPS), satellite radio, etc. With this demand comes a need for low-cost miniaturized planar antennas. The multitude of wireless services requires multiple antennas to cover the different frequency bands and functions. Also, the demand for dual-band phones is ever growing, as people increasingly tend to use both analog and digital communications services. Further, both cellular phone and PCS antennas require an omni-directional pattern.

Additionally, it is desirable that the size of the communication apparatus and the transmitting or receiving antennas be small. This becomes even more of a necessity when multiple antennas have to be mounted in a limited area. In military applications, a small antenna size is critical for low radar visibility, and to increase system survivability. In commercial applications, small size alleviates problems with styling, vandalism and aerodynamic performance. Size reduction is especially useful in low frequency applications in the HF, VHF, UHF and L frequency bands ranging from 30 to 3000 MHz. The wavelengths in these bands range from 10 m to 10 cm. Considering the fact that a resonant dipole is about a half-wavelength long, the motivation behind size reduction is obvious.

For low frequency applications, low-profile printed antennas include printed microstrip dipole and printed slot antennas. Printed antennas essentially comprise a printed circuit board with a trace layout. The trace layouts can be made using chemical etching, milling or other known methods. These antennas enjoy a host of advantages including ease of manufacture, low cost, low profile, conformality, etc.

FIGS. 1(*a*) and 1(*b*) show a known printed slot antenna 10 including a metallized ground plane 16 and a microstrip feed line 12 printed on opposite sides of a printed circuit board (PCB) 14. A linear slot element 18 is cut out of the ground plane 16 by a suitable etching step or the like. The microstrip line 12 is connected to the ground plane 16 at the edge of the slot element 18 by a shorting pin 20 extending through the PCB 14.

Various techniques are known in the art to reduce the size of a printed slot antenna of the type shown in FIGS. 1(*a*) and 1(*b*). For example, it is known to use dielectric lenses to reduce the size of a printed antenna. U.S. Pat. No. 6,081,239 issued Jun. 27, 2000 to Sabet et al. discloses a planar printed antenna that employs a high dielectric superstrate lens having a plurality of air voids that set the effective dielectric constant of the material of the lens to reduce resonant waves in the lens, thus reducing power loss in the antenna. The superstrate with air voids allows the size of the dipoles or slots to be reduced for any particular frequency band.

It is also possible to reduce the area occupied by a linear antenna element by bending or winding the antenna element into a curved or twisted shape. FIGS. 2(*a*) and 2(*b*) show a linear slot element 22 being wound to illustrate this technique. However, bending the antenna element 22 immediately results in a sharp reduction of its bandwidth. This can be verified by numerical modeling and computer simulation.

FIG. 3 shows the effect of gradually bending a slot antenna element 24 and how it affects the antenna bandwidth, near field, and vertical and horizontal polarization. This simulation shows that more windings result in a more omni-directional antenna pattern, but the bandwidth of the antenna element 24 is reduced.

A wound slot antenna element has to be fed at a location close to its end because the input impedance at its center is very high. The antenna element can be fed using a microstrip line printed on the other side of the substrate with a matching extension or a shorted via hole, as shown in FIGS. 1(*a*) and 1(*b*). A coaxial cable can also be used, where its outer conductor is connected to the ground area of the slot antenna and its inner conductor is shorted through the slot.

One of the current design challenges for making multifunction antennas includes providing a plurality of different antenna elements in a single compact structure. One particular application where multiple antennas are needed in a compact and low cost design is for a vehicle antenna that is used for all of GPS, satellite radio, advance mobile phone service (AMPS), PCS and group special mobile (GSM) systems. Combining so many antennas in a single structure provides various design challenges that have heretofore not been met in the art. One design challenge includes making some of the antennas, such as the GPS and the satellite radio antennas, circularly polarized with an upward looking beam to accommodate signals from satellites. Other antennas, such as the AMPS, PCS and GSM antennas, require omni-directional and vertically polarized radiation patterns to receive and transmit terrestrial signals. Thus, there is a need to provide all of the antennas on a common structure and still satisfy these needs.

SUMMARY OF THE INVENTION

In accordance with the teachings of the present invention, a multifunction printed antenna is disclosed including antenna elements for wireless and telematic applications, including, but not limited to, GPS, satellite radio, terrestrial radio, AMPS, PCS and GSM frequencies. In one embodiment, the GPS and satellite antenna elements are patch antenna elements printed on one side of a printed circuit board, and the AMPS, PCS and GSM antenna elements are slot antenna elements etched in a ground plane on an opposite side of the same printed circuit board. The circuit board is mounted at an angle relative to the horizon so that the patch antenna elements for the GPS and satellite radio frequencies are at least partially horizontally oriented relative to the horizon, and the slot antenna elements for the terrestrial radio, AMPS, PCS and GSM frequencies are at least partially vertically oriented relative to the horizon to provide radiation patterns in the desired direction. The patch antenna elements can be corner fed or edge fed to be circularly polarized.

In an alternate embodiment, the GPS and satellite antenna elements are patch antenna elements mounted on one printed circuit board and the terrestrial radio, AMPS, GSM and PCS antenna elements are slot antenna elements etched in a ground plane of another printed circuit board mounted orthogonal to the GPS and satellite radio printed circuit board. The terrestrial radio, AMPS, GSM and PCS printed circuit board can be curved to reduce the nulls at the edges of the circuit board and provide a more omni-directional radiation pattern. Further, the edge of the terrestrial radio, AMPS, GSM and PCS printed circuit board that contacts the GPS and satellite radio printed circuit board can have a saw-toothed pattern so that edge currents are reduced at the connection between the two circuit boards to have a lesser impact on the circular polarization performance of the patch elements.

In the various embodiments discussed herein, low noise amplifiers (LNAs) can be mounted on the GPS and satellite radio printed circuit board. Further, diplexers, duplexers, filters, amplifiers and other circuit components can be mounted on the terrestrial radio, AMPS, PCS and GSM printed circuit board to provide component integration, reduce system hardware and conserve space.

Additional objects, advantages, and features of the present invention will become apparent from the following description and appended claims, taken in conjunction with the accompanying drawings.

DETAILED DESCRIPTION OF THE EMBODIMENTS

The following discussion of the embodiments of the invention directed to a multifunction antenna for wireless and telematic applications is merely exemplary in nature, and is in no way intended to limit the invention or its applications or uses.

Figure 1A:
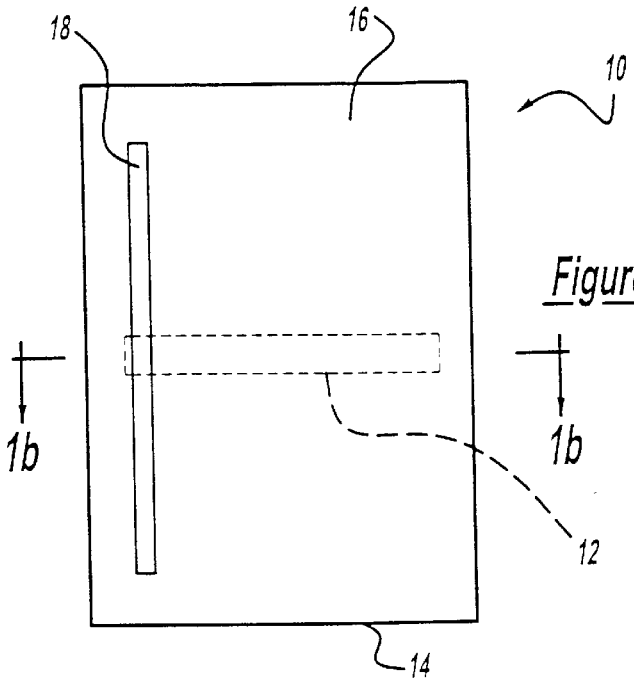
FIGS. 1(*a*) and 1(*b*) is a top view and a cross-sectional view, respectively, of a conventional printed slot antenna having a microstrip feed line.
Figure 1B:
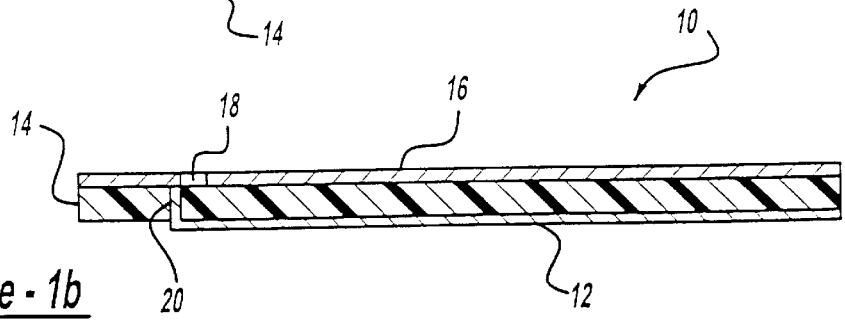
Figure 2A:
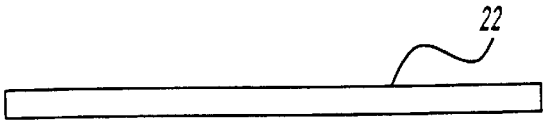
FIGS. 2(*a*) and 2(*b*) show bending a printed antenna element to reduce the antenna size.
Figure 2B:
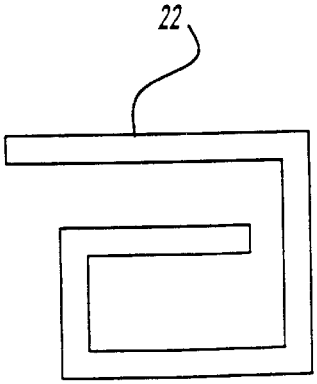
Figure 3:
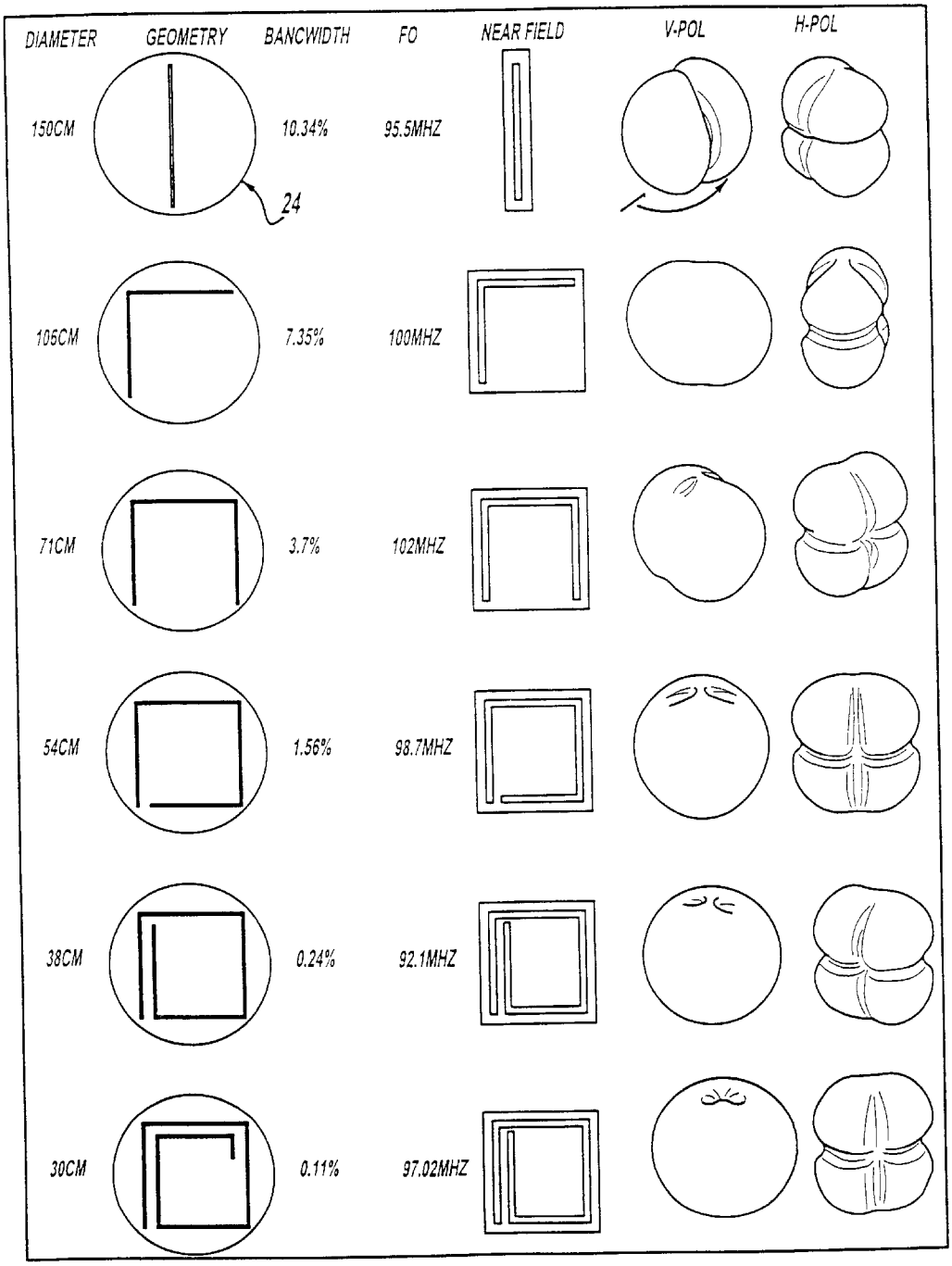
FIG. 3 shows a series of slot antennas that depict the effect of bending the antennas on the reduction of bandwidth.
Figure 4:
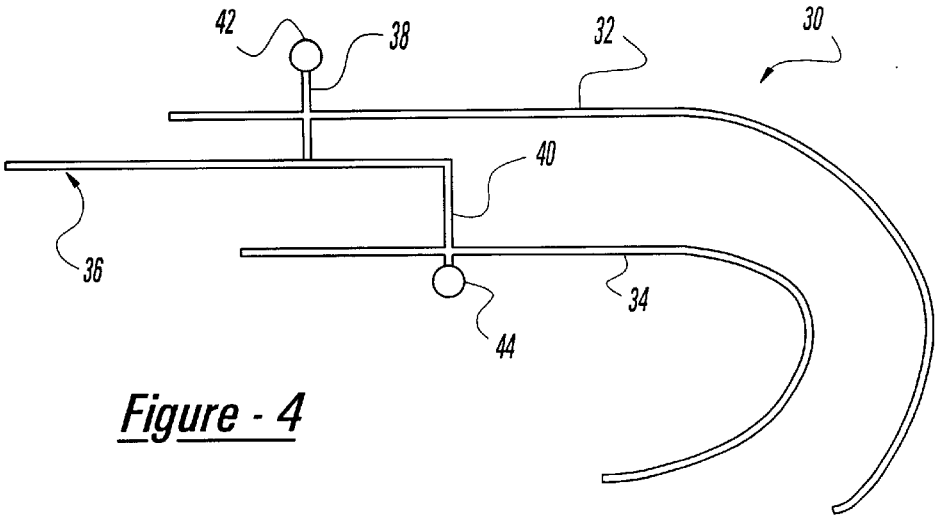
FIG. 4 is a plan view of a multi-trace antenna design, according to an embodiment of the present invention.

To overcome the limitations of reduced bandwidth for a curved or wound antenna design, the present invention proposes a multi-trace antenna design consisting of two or more slot antenna elements of different lengths configured in a relatively parallel orientation. FIG. 4 is a plan view of a printed antenna 30 having such a design, where the printed circuit board is removed for clarity. The antenna 30 includes two wound, resonating slot antenna elements 32 and 34 that represent slots etched in a ground plane, such as the ground plane 16, formed on a printed circuit board, such as the printed circuit board 14. A feed line 36, that is a conductive microstrip patterned on an opposite surface of the printed circuit board, includes a feed stub 38 that feeds the element 32 and a feed stub 40 that feeds the element 34. The feed stub 38 is connected to a shorting via 42 that extends through the printed circuit board and is shorted to the ground plane on the opposite side of the printed circuit board proximate to the element 32, as shown. Likewise, the feed stub 40 is connected to a shorting via 44 that extends through the printed circuit board and is shorted to the ground plane proximate to the element 34, as shown.

As will be discussed in greater detail below, the resonating elements 32 and 34 are coupled to produce a desired wide bandwidth. In alternate embodiments, more than two wound slot antenna elements can be coupled together within the scope of the present invention.

Each slot element 32 and 34 resonates at its resonant frequency proportional to its physical length, but with limited bandwidth. However, the overall antenna 30 exhibits a multi-resonant response from the combination of the resonant frequencies for both elements 32 and 34. Because of electromagnetic coupling between the adjacent slot elements 32 and 34, the overall response of the multi-trace antenna 30 is not a simple superposition of the individual responses. By properly adjusting the spacing between the elements 32 and 34, their physical lengths and the feed location of each, it is possible to achieve different multi-band frequency responses with distinct resonant peaks. This can be done through a computer simulation and optimization. For a wide-band operation, the electromagnetic coupling between the neighboring slot elements can be exploited to fill the gaps between the resonant peaks, and thus broaden the bandwidth.

Figure 5A:
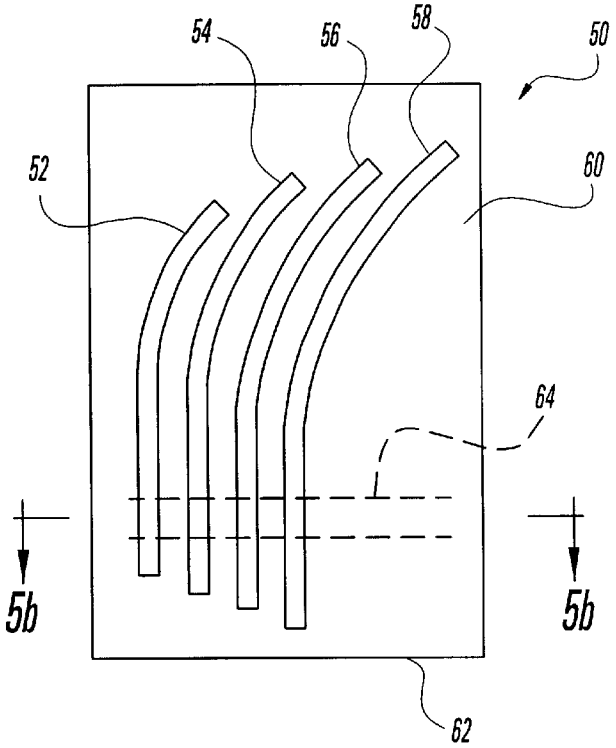
FIGS. 5(*a*) and 5(*b*) are a top view and a cross-sectional view, respectively, of a multiple slot antenna and its feed, according to the invention.
Figure 5B:
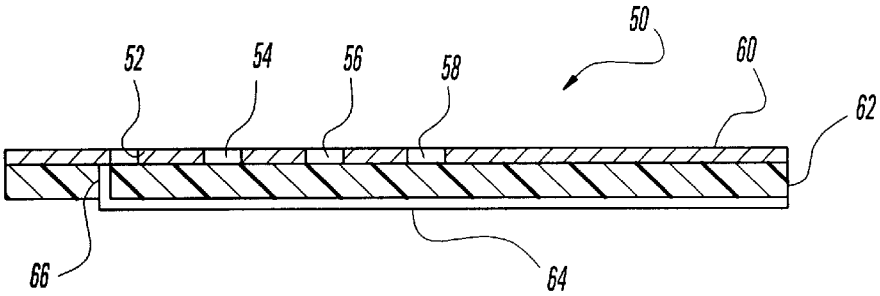

FIGS. 5(*a*) and 5(*b*) provide further support of the invention as to how tightly coupled slot elements can increase the antenna's effective bandwidth. FIGS. 5(*a*) and 5(*b*) show an antenna 50 that is a modification of the dipole antenna 10 discussed above having four slot elements 52, 54, 56 and 58. The antenna 50 includes a small ground plane 60 patterned on one side of a printed circuit board 62, and a microstrip feed line 64 patterned on an opposite surface of the printed circuit board 62. The slot elements 52, 54, 56 and 58 are etched out of the ground plane 60. The microstrip feed line 64 is connected to a vertical via 66 that extends through the printed circuit board 62 and is shorted to the ground plane 60 proximate the slot element 52.

In this configuration, the microstrip line 64 feeds the slot elements 52, 54, 56 and 58. Each slot element resonates at its own resonant frequency, which depends on the length of the element. Due to the tight coupling between the four elements, the overall bandwidth of the printed antenna 50 is increased. The length of the elements 52, 54, 56 and 58, the feed location of the vertical via 66 and the spacing between the slot elements 52, 54, 56 and 58 are selectively controlled to control the bandwidth as well as the resulting radiation pattern.

Figure 6A:
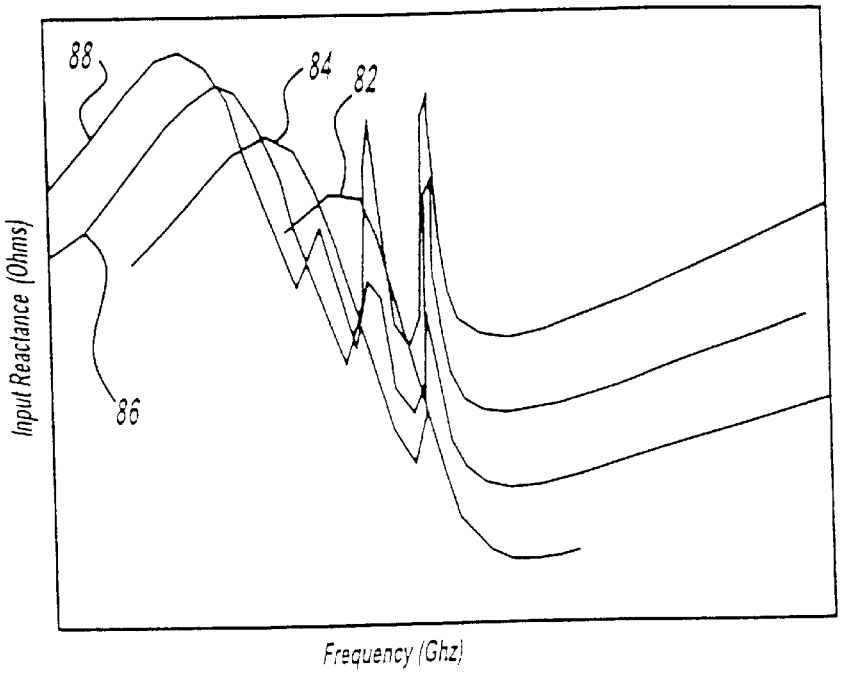
FIGS. 6(*a*) and 6(*b*) are two graphs showing the input impedance behavior of a multi-slot antenna of the invention.
Figure 6B:
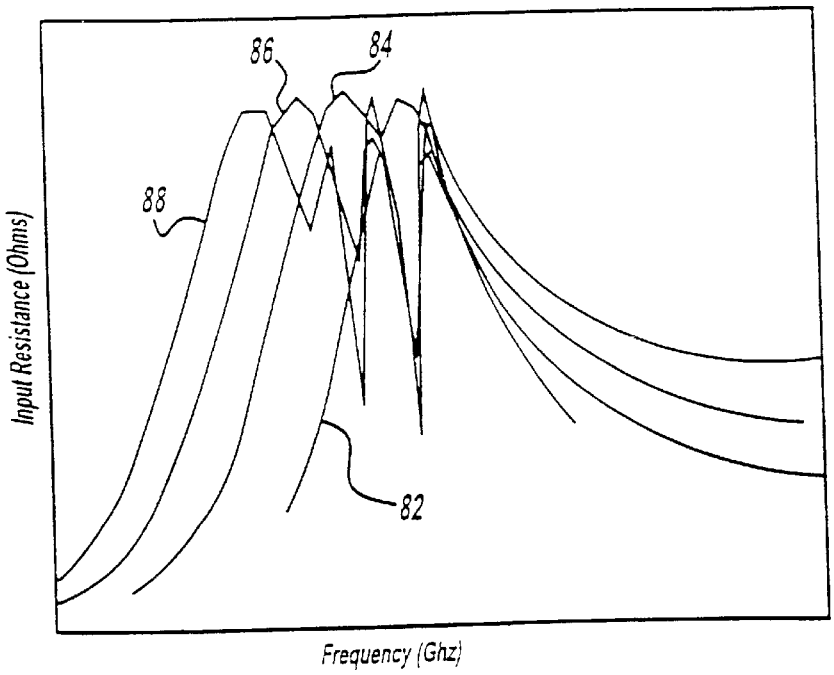

FIG. 6(*a*) is a graph with frequency on the horizontal axis and input reactance on the vertical axis, and FIG. 6(*b*) is a graph with frequency on the horizontal axis and input resistance on the vertical axis showing the bandwidth performance of the antenna 50 for various combinations of the elements 52–58. Particularly, graph line 82 is for the antenna 50 with only the slot element 52 present, graph line 84 is for the antenna 50 with the slot elements 52 and 54 present, graph line 86 is for the antenna 50 with the slot elements 52, 54 and 56 present, and graph line 88 is for the antenna 50 with all four of the slot elements 5258 present. As is apparent, improved bandwidth performance is achieved by tightly coupling more slot elements of different lengths.

Figure 7:
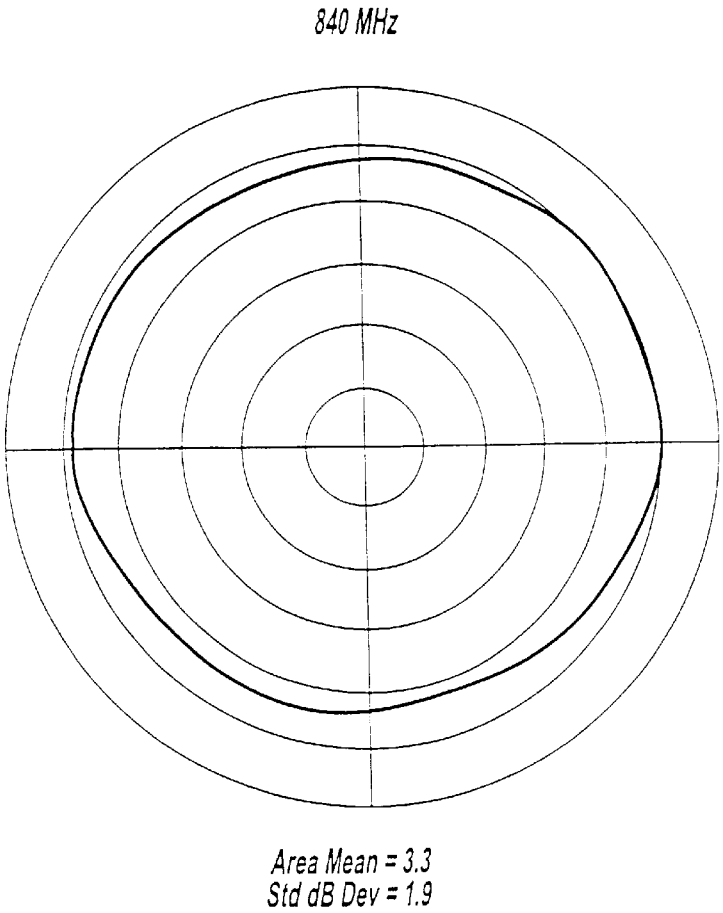
FIG. 7 is a graph showing an omni-directional radiation pattern of a printed slot antenna according to the various embodiments of the present invention.

Printed slot antennas on thin substrates or printed circuit boards radiate almost equally into both sides of the antenna. In order to have a vertically polarized omni-directional radiation pattern as normally required by most ground-based wireless services, the multi-band antenna described above is printed on a thin vertical PCB card with a small-size ground plane. In this case, due to the finiteness of the antenna, it will exhibit an omni-directional pattern in the azimuth plane. FIG. 7 is a graph showing the radiation pattern for an 840 MHz printed slot antenna of the type being described herein. As is apparent, these printed slot antennas provide a substantially omni-directional radiation pattern. There might be a slight degradation of the pattern at the edges of the PCB card. However, the nulls normally seen at the edges of large ground planes are not present in this design. For this purpose, the size of the ground plane should be comparable to the wavelength.

It should be noted that the use of coupled parasitic elements for bandwidth enhancement has been proposed and utilized in the past, particularly, in Yagi-Uda arrays. In this type of design, the active and parasitic elements together form an array to achieve a directional radiation pattern. The spacing between the elements, however, is about a half wavelength to achieve the desired directionality. Moreover, the elements are usually linear dipoles with lengths around a half wavelength.

Single trace wound slot antenna elements are inherently narrow-band. Winding them several turns can make them omni-directional. In certain applications, such as for garage door openers or keyless remote entry devices, it is desirable to have a very narrow band, but compact, antenna that is highly omni-directional. A tightly wound slot dipole antenna vertically mounted relative to the horizon provides such an antenna.

Figure 8:
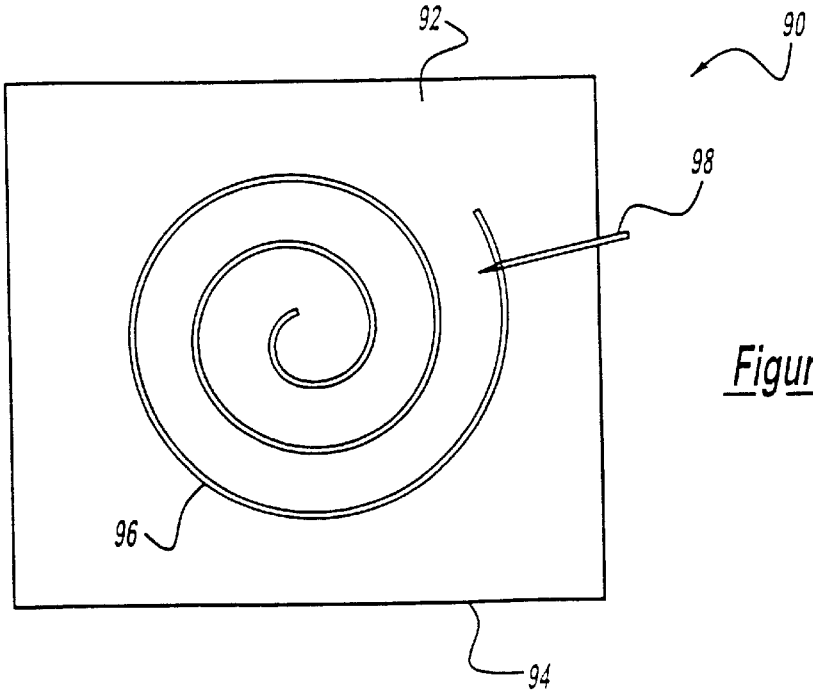
FIG. 8 is a compact UHF antenna, according to the invention, that is tuned at 390 MHz with a bandwidth of 1 MHz.

FIG. 8 is a top front view of a compact UHF antenna 90 tuned at 390 MHz with a bandwidth of 1 MHz. The antenna 90 includes a ground plane 92 patterned on a printed circuit board 94, where a wound slot element 96 is configured in the ground plane 92. The wound slot element 96 can be fed either by a coaxial feed line 98 on the same side of the printed circuit board 94 as the slot element 96 or by a microstrip feed line printed on the other side of the printed circuit board 94, as described above. The antenna 90 is not a wound spiral antenna of the type known in the art because it is fed proximate an outer end of the element 96. Further, in this embodiment, the ground plane 92 is limited (small in size), and adds to the compact size of the antenna 90. The length of the element 96 determines the resonant frequency of the antenna 90. In this embodiment, the ground plane 92 is square and has side dimensions less than one-half the wavelength of the resonant frequency of the element 96. For a resonant frequency of 390 MHz, the ground plane 92 is about a 4 inch by 4 inch square in this embodiment.

Figure 9:
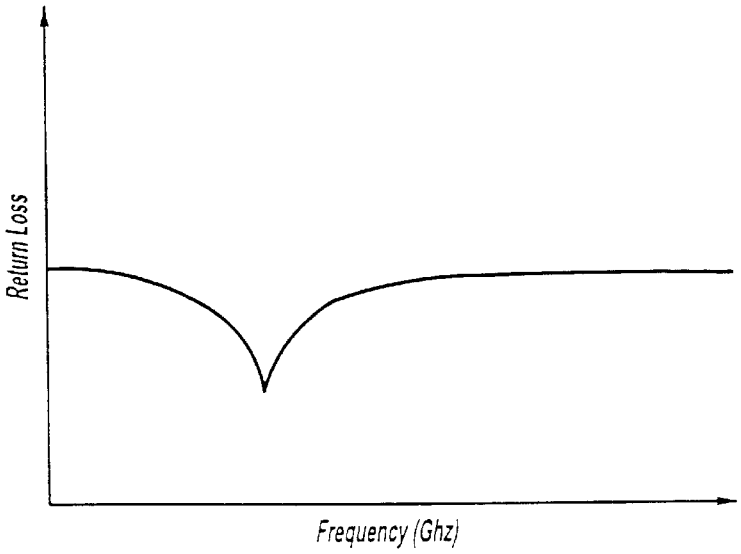
FIG. 9 is a graph showing the return loss of the antenna shown in FIG. 8.

The narrow-band antenna 90 is suitable for remote control systems, such as garage door openers and remote keyless entry devices. The sharp resonance of the antenna 90 eliminates the need for additional noise rejection band-pass filters. FIG. 9 is a graph with frequency on the horizontal axis and return loss on the vertical axis depicting the narrow band resonant frequency of the antenna 90.

Figure 10:
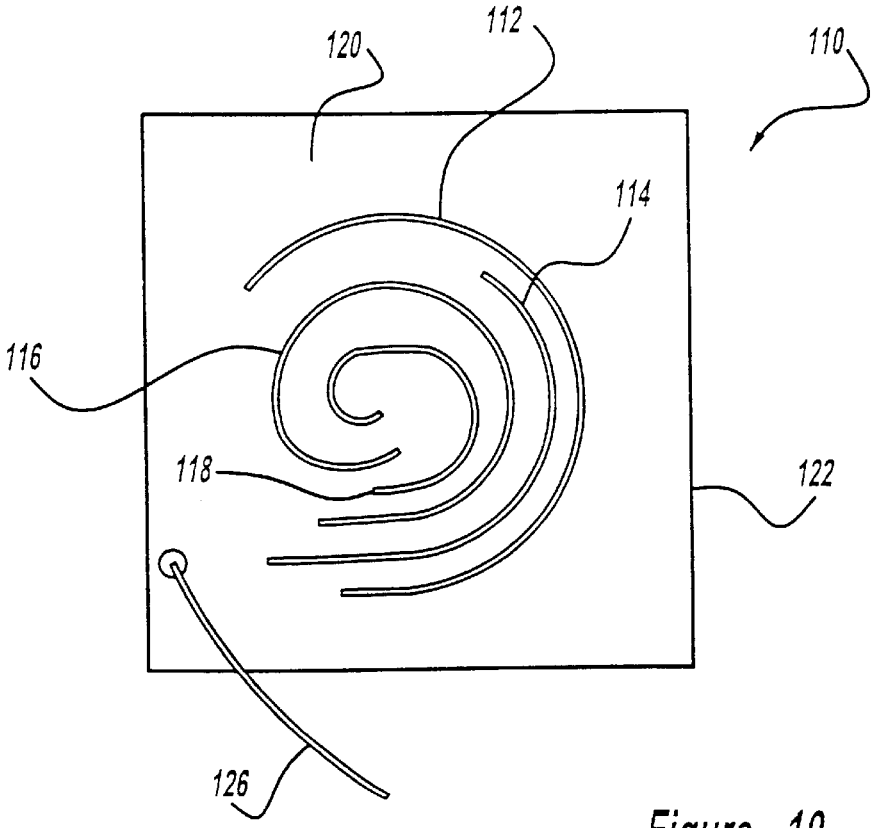
FIG. 10 is a plan view of a dual band antenna design, according to an embodiment of the present invention, that covers the AMPS band and the PCS band.

FIG. 10 is a top view of a dual band cellular phone antenna 110 including four wound slot elements 112–118 that are etched into a ground plane 120 on a printed circuit board 122, according to another embodiment of the present invention. The elements 112–118 resonate at different frequencies that cover the AMPS band (824 MHz–894 MHz) and the PCS band (1850 MHz–1990 MHz). The dual band antenna 110 has a single cable 126 that is connected to the ground plane 120 and feeds all of the elements 112–118. The cable 126 consists of a power distribution network printed on the back of the circuit board. In this design, the two outer slot elements 112 and 114 correspond to AMPS cellular phone operation while the two inner slot elements 116 and 118 correspond to PCS operation.

Figure 11:
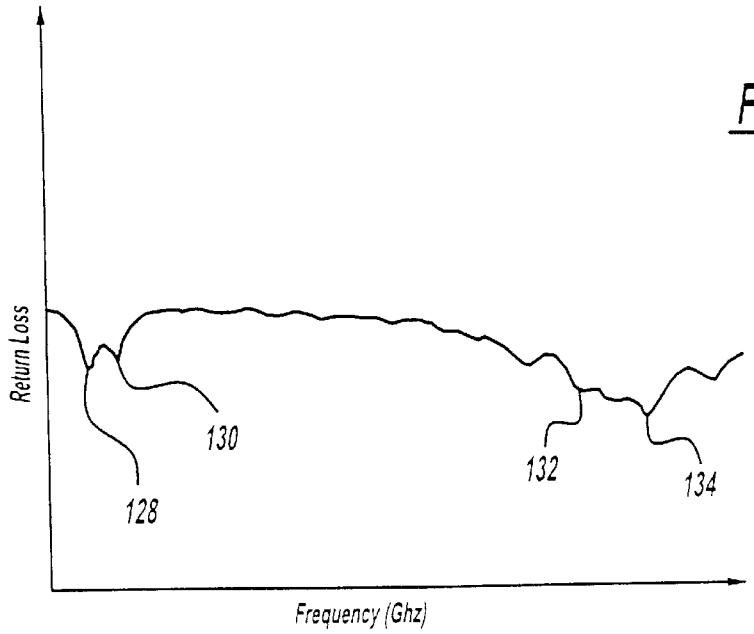
FIG. 11 is a graph showing the return loss of the antenna shown in FIG. 10.

FIG. 11 is a graph with frequency on the horizontal axis and return loss on the vertical axis showing the resonant frequencies of the elements 112–118. The combination of the resonant peaks 128 and 130 provide a wide bandwidth for the AMPS antenna applications, and the combination of the peaks 132 and 134 provide a wide bandwidth for the PCS antenna applications.

Conformality is one of the major advantages planar antennas have to offer. When these antennas are printed on thin substrates, they can conform to the contour of the application surface. In commercial applications, the antenna can be embedded on the surface of a vehicle body or into the surface of a system enclosure, such as a telephone handset, a garage door opener housing, or a personal digital assistant or laptop computer cover. In military applications, the antenna can be hidden inside a platform or stretched on its surface to minimize radar visibility.

Figure 12:
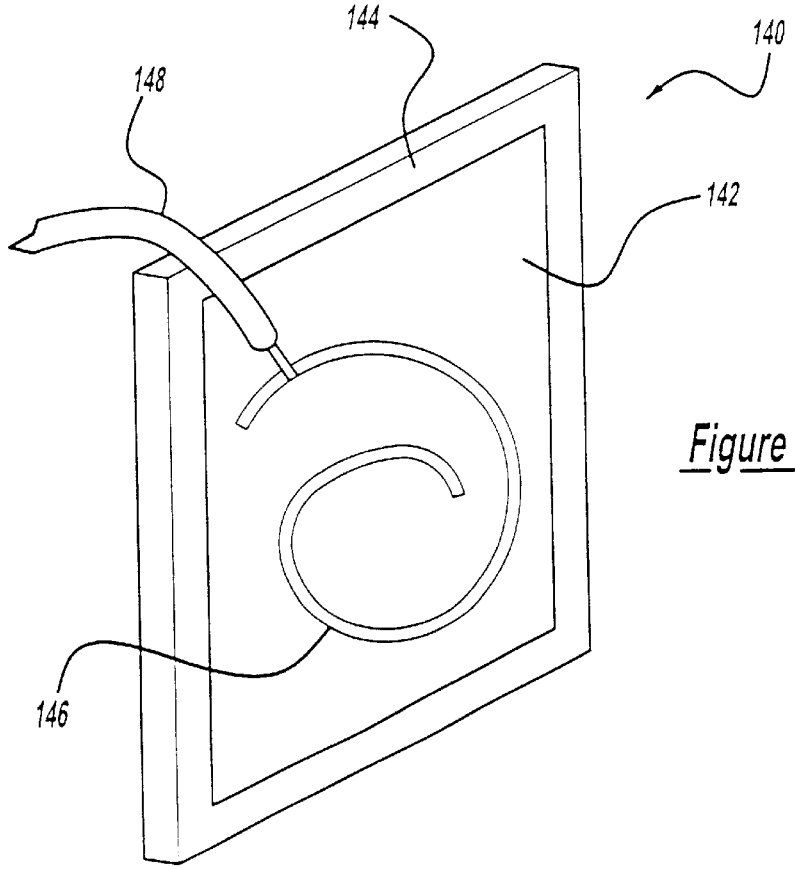
FIG. 12 is a perspective view of a sticker antenna design, according to an embodiment of the present invention.

Slot antenna designs based on this invention can be realized by stamping their layout pattern on copper tape to create a "sticker" antenna. The copper tape can then be readily mounted on a glass platform or any other surface. To depict this embodiment of the present invention, FIG. 12 shows a perspective view of an antenna 140 including a copper tape 142 adhered to a glass surface or substrate 144. A wound slot element 146 is formed in the copper tape 142, and is fed by a coaxial feed cable 148. In this case, the dielectric properties of the mounting surface have to be taken into account in the design of the trace layout.

It is possible to print the slot antenna designs discussed above on an existing non-metallic platform, such as glass or a low-loss plastic or ceramic slab. This can be done in the form of a conductive coating or metallization deposit, or using adhesive pre-stamped metallic foils over the non-metallic surface. In particular, by using a high permittivity ceramic slab, the overall size of the antenna can be reduced drastically. In either case, a major requirement is to be able to feed the different antenna elements all from one side of the structure because a platform occupies the other side. According to another embodiment of the present invention, a co-planar waveguide (CPW) feed network is employed in conjunction with multifunction slot antennas. In this case, the entire antenna structure can be realized using metallization on one side of a non-metallic platform.

As discussed above, printed antennas provide low-cost, low-profile, integrated solutions for many antenna applications. By printing different types of planar antennas on the same substrate, an integrated multifunction antenna can be achieved. According to another embodiment of the present invention, a multifunction, integrated GPS/cellular/PCS/GSM antenna is disclosed. A broad band slot spiral is used for the circularly polarized GPS antenna, which can also receive other satellite signals of the same polarization within its band. The cellular AMPS/PCS/GSM antenna is based on the compact multi-band omni-directional design discussed above, and is accommodated on the same aperture with proper spacing and topology.

Figure 13:
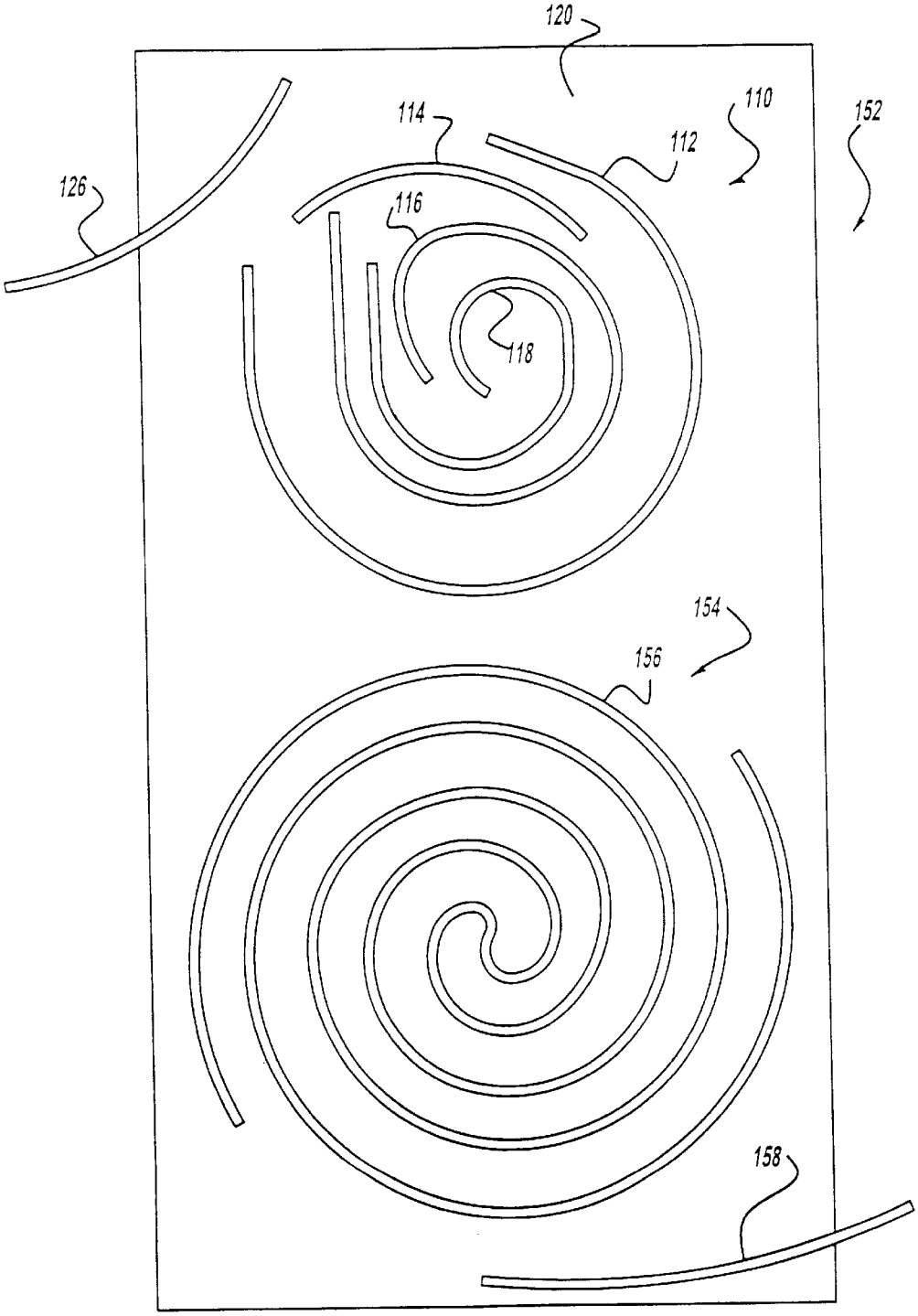
FIG. 13 is a front view of an integrated, multifunction GPS/cellular/PCS/GSM antenna, according to an embodiment of the present invention.

FIG. 13 is a front view of a multifunction, integrated GPS/cellular/PCS/GSM antenna 152 of this type. The antenna 152 includes the antenna 110 discussed above having the four slot elements 112–116 tuned to the desirably frequency band. However, in this embodiment, the ground plane 120 has been extended so that a printed GPS antenna 154 can be provided in combination with the antenna 110. In this embodiment, the GPS antenna 154 includes a spiral slot element 156 that is tuned to a particular resonant frequency band for GPS operation. The GPS antenna 154 is fed by a feed line 158 electrically connected to the ground plane 120 as shown.

Cirius and XM satellite radio systems require an antenna that not only receives circularly polarized (CP) satellite signals, but is also able to receive vertically polarized signals from ground-based stations. Therefore, an antenna for this application should have both a directional upward-looking CP radiation pattern with some gain and a vertically polarized omni-directional pattern. In accordance with the teachings of another embodiment of the present invention, the antenna design consists of a spiral slot antenna with a CP operation combined with a compact omni-directional printed antenna for the linear polarization of the type discussed above. The two antenna elements share a common aperture and are printed on the same printed circuit board. The PCB card should be oriented upright at a small angle from zenith (about 30 degrees). In this case, the vertical polarization performance will be satisfactory, while the CP antenna will exhibit a good performance due to its broad beamwidth.

In the above-mentioned multifunction integrated antenna designs, the spiral slot antenna can be replaced with any other planar antenna that provides a CP operation. One example is a cross-slot antenna that is fed near the ends of two adjacent arms of the cross with proper phase difference. In particular, when a uniplanar multifunction antenna is desired, which has to be printed entirely on one side of a non-metallic platform, the present invention proposes a CPW balanced feed for the broadband spiral antenna design that is fit between the two arms of the dual-arm spiral. A CPW feed network is also designed for the omni-directional antenna for the cellular/PCS/GSM operation.

Figure 14:
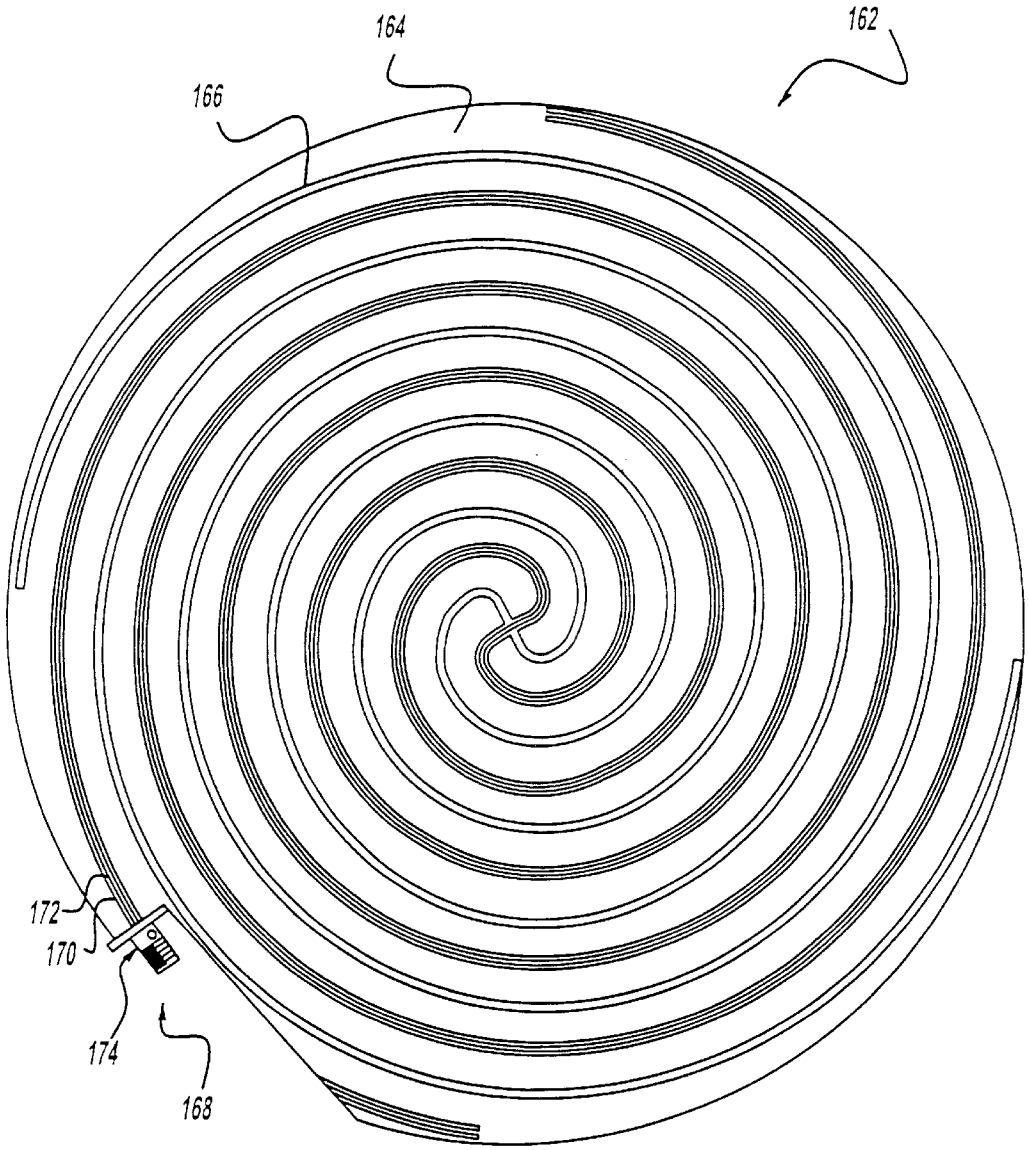
FIG. 14 is a front view of a multifunction, integrated spiral slot antenna, according to another embodiment of the present invention, that employs a CPW balanced feed.

FIG. 14 is a front view of a CPW-fed, printed spiral slot antenna 162 employing this design. The antenna 162 includes a ground plane 164 formed on one side of a PCB. A spiral slot element 166 is etched in the ground plane 164, and is of the same type as the slot element 156 discussed above. A CPW feed network 168 is provided where a spiral slot element 170 is formed in the ground plane 164 parallel to the slot element 166, as shown. A center conductor 172 is formed in the slot element 170, and is connected to an inner conductor of a coaxial connector 174, as shown. The outer conductor of the coaxial connector 174 is electrically connected to the ground plane 164. The slot element 170 and the center conductor 172 together form a balanced coplanar waveguide feed for the spiral slot element 166.

Figure 15:
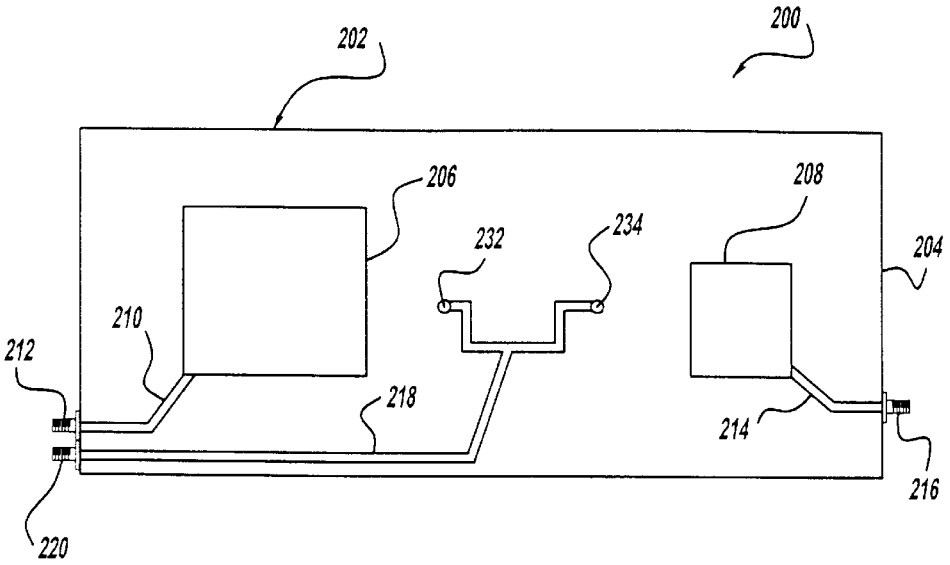
FIG. 15 is a front view of a multifunction antenna for wireless and telematic applications, according to an embodiment of the present invention.
Figure 16:
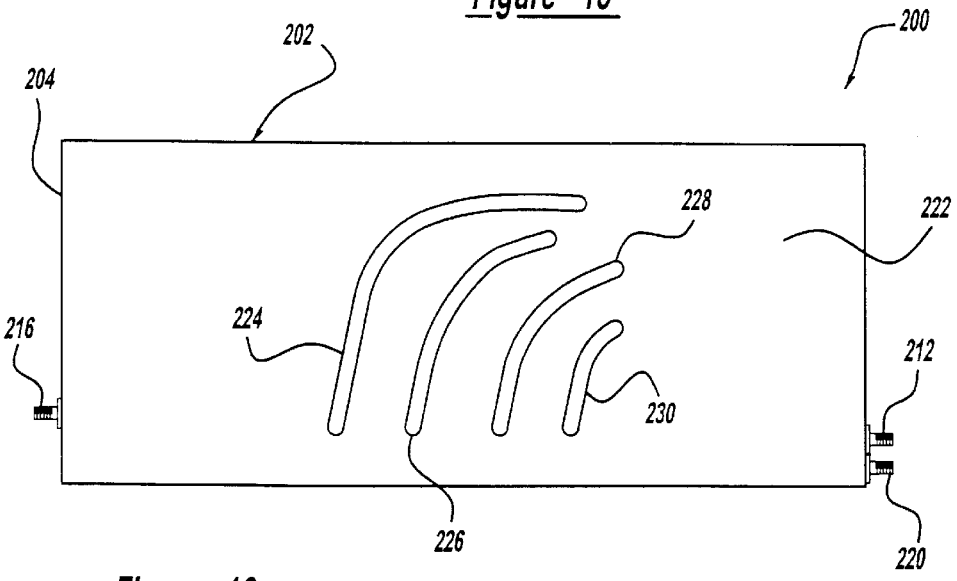
FIG. 16 is a back view of the antenna shown in FIG. 15.

FIG. 15 is a front view and FIG. 16 is a back view of a multifunction antenna 200 for wireless and telematic applications, according to another embodiment of the present invention. In this embodiment, the antenna 200 is a five-band or five function antenna that includes resonating antenna elements providing the desired resonant frequency for each of GPS, satellite radio, AMPS, PCS, GSM and terrestrial radio, as will be discussed below. In this discussion, the satellite radio and the terrestrial radio are part of the same satellite digital audio radio service (SDARS) and combine to provide a single function. All of the antenna elements are formed on a common PCB 202 including a dielectric substrate 204. In one embodiment, the substrate 204 has a high permativity (>10) that makes the overall size of the antenna 200 smaller. Other techniques can be employed to make the antenna 200 smaller, such as dielectric lenses and the like, well known to those skilled in the art. In one embodiment, the antenna 200 has a particular application for use in a vehicle. The antenna 200 can be mounted to any suitable location on the vehicle, such on the vehicle glass, windshield, instrument panel, duck bill (extension of headliner), rear shelf package, inside spoiler, bumper, etc.

The antenna 200 includes a GPS patch antenna element 206 and an SDARS satellite radio antenna element 208. As is known in the art, patch antenna elements are formed by a planar metal structure, here square patches, having the desirable shape and size for the particular frequency band of interest. The antenna element 206 is corner fed by a microstrip feed line 210 coupled to an electrical connector 212 to provide circular polarization for satellite signals. Likewise, the antenna element 208 is corner fed by a microstrip feed line 214 coupled to an electrical connector 216 to provide circular polarization. Another microstrip feed line 218 is patterned on this side of the substrate 204 to feed the AMPS, PCS, GSM and terrestrial radio antenna elements discussed below. The feed line 218 is coupled to an electrical connector 220. The patch antenna elements 206 and 208 and the microstrip feed lines 210, 214 and 218 are formed by etching a metal layer, such as copper, deposited on this side of the substrate 204 by a deposition and etching process well known to those skilled in the art.

The other side of the substrate 204 includes a metallized ground plane 222 in which is formed a series of slot antenna elements for the AMPS, PCS, GSM and terrestrial radio frequencies. Particularly, an AMPS slot element 224, a PCS slot element 226, a GSM slot element 228 and an SDARS terrestrial radio slot element 230 are etched in the ground plane 222 to receive and transmit the appropriate frequency signals. As is apparent, the slot antenna elements 224–230 are curved slot elements to reduce the size of the antenna 200. The elements 224–230 have the appropriate length for the frequency band of interest and generally follow the same contour. As will be appreciated by those skilled in the art, the position and shape of the elements 224–230 can be changed within the scope of the present invention.

As discussed above, winding slot antenna elements reduces the bandwidth. However, it is sometimes desirable to have a narrow bandwidth for a particular application. Further, the elements 224–230 couple together, as discussed above, to provide a wide bandwidth. The slot antenna elements 224–230 are fed by the microstrip feed line 218. The feed line 218 is electrically coupled to shorting vias 232 and 234 that extend through the substrate 204 and are electrically coupled to the ground plane 222 proximate the slot antenna elements 224–230.

Because the antenna 200 is used for satellite and terrestrial based applications, the orientation of the radiation patterns of the patch and slot elements 206, 208 and 224–230 must be proper to receive and/or transmit the desired signals. As is known in the art, satellite signals are circularly polarized and terrestrial signals are vertically polarized. Therefore, it is typically desirable to provide satellite antennas oriented horizontally and directed towards the sky to receive the satellite signals. However, it is also desirable that the terrestrial based antenna elements be linearly polarized where the antenna is oriented vertically relative to the horizon and is omni-directional. In one embodiment, the antenna 200 is mounted at an angle relative to the horizon to provide at least a partial vertical orientation for the terrestrial antenna elements (PCS, AMPS, GSM) and at least a partial horizontal orientation for the satellite antenna elements (GPS, satellite radio). Thus, all of the antenna elements 206, 208 and 224–230 are able to receive the signals.

Figure 17A:
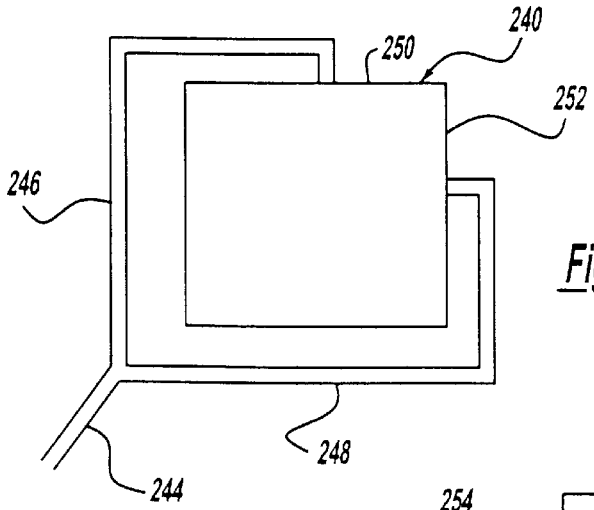
FIGS. 17(*a*) and 17(*b*) are plan views of edge fed patch antennas for the GPS and satellite radio antenna elements shown in FIG. 15.
Figure 17B:
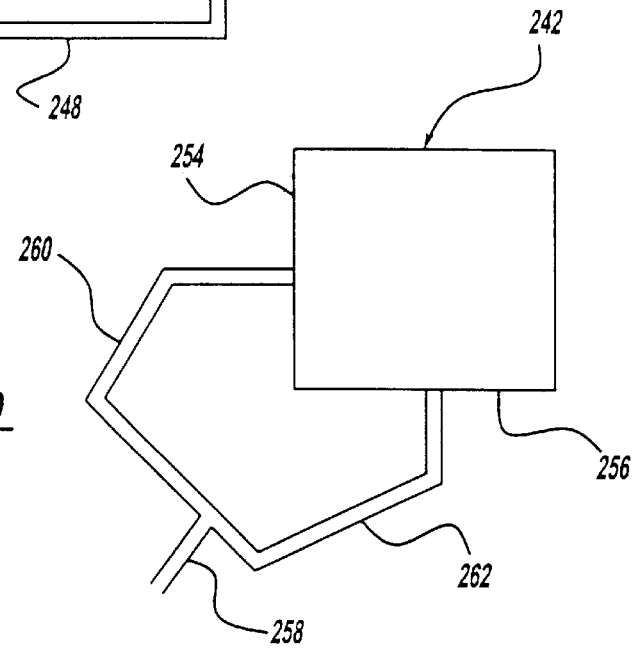

As discussed above, the patch antenna elements 206 and 208 are corner fed to provide the desired circular polarization. In an alternate embodiment, the patch antenna elements 206 and 208 can be edge fed and still provide circular polarization. FIGS. 17(*a*) and 17(*b*) are plan views of patch antenna elements 240 and 242, respectively, that are edge fed and provide circular polarization. Particularly, the antenna element 240 is fed by a microstrip feed line 244 that is separated into feed branches 246 and 248 coupled to orthogonal edges 250 and 252, respectively, of the element 240. By feeding orthogonal edges of the element 240, the resulting radiation pattern provides circular polarization. Orthogonal edges 254 and 256 of the patch element 242 are fed by a microstrip feed line 258 separated into branches 260 and 262, as shown. The length of the feed branches 246, 248, 260 and 262 provide the correct phasing for circular polarization.

Figure 18:
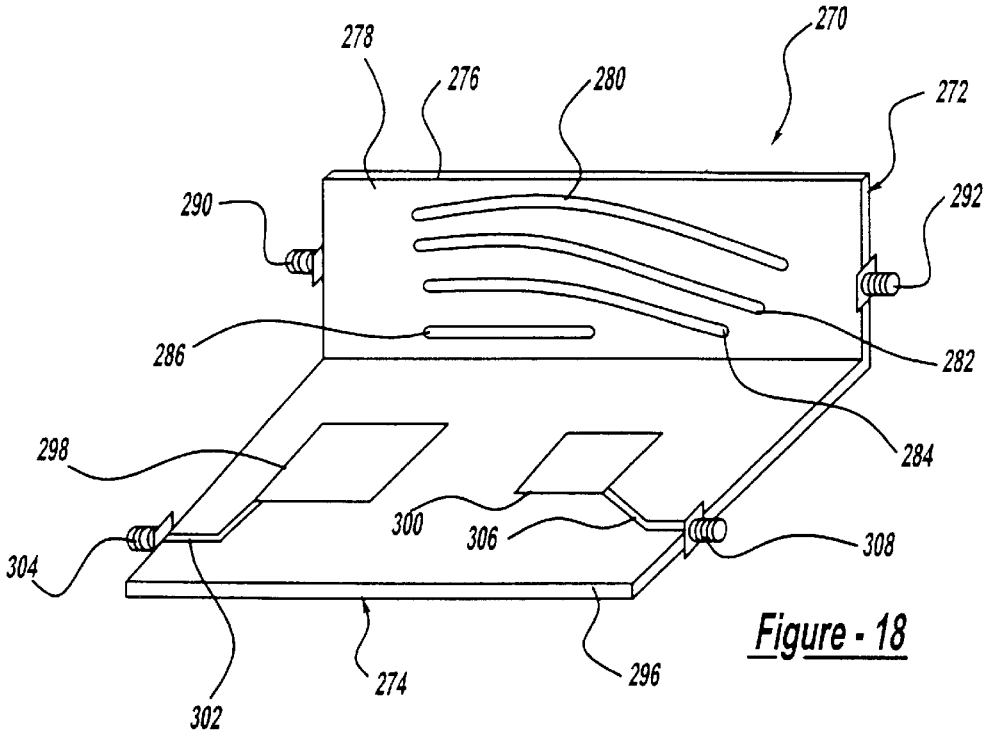
FIG. 18 is a perspective view of a multifunction antenna for wireless and telematic applications, where GPS and satellite radio patch antenna elements are configured on one printed circuit board and terrestrial radio, AMPS, GSM, PCS antenna elements are configured on an orthogonal printed circuit board as part of a common structure, according to another embodiment of the present invention.

FIG. 18 is a perspective view of a multifunction antenna 270 for wireless and telematic applications, according to another embodiment of the present invention. The antenna 270 includes a first PCB 272 and a second PCB 274 mounted orthogonal to each other, as shown, by any suitable technique. The PCB 272 includes a substrate 276 on which is deposited a metallized ground plane 278. As above, slot antenna elements are etched in the ground plane 278 and include an AMPS slot element 280, a PCS slot element 282, a GSM slot antenna element 284 and a terrestrial radio slot element 286. The elements 280–286 are fed in the same manner discussed above for the antenna 200, where a feed line is patterned on an opposite side of the substrate 276 and is coupled to electrical connectors 290 and 292.

Further, as discussed above, the PCB 274 includes a substrate 296 including a GPS patch antenna element 298 and a satellite radio patch antenna element 300. The antenna element 298 is corner fed by a microstrip feed line 302 coupled to an electrical connector 304, and the antenna element 300 is corner fed by a microstrip feed line 306 coupled to an electrical connector 308. In this embodiment, the antenna 270 is mounted to the support structure so that the orientation of the PCB 272 provides the radiation patterns for terrestrial signals and the PCB 274 is oriented in the proper direction for satellite signals. The PCBs 272 and 274 can be "sticker" type PCBs, discussed above, to be stuck to the corner of a support structure to provide the desired orientation.

Figure 19:
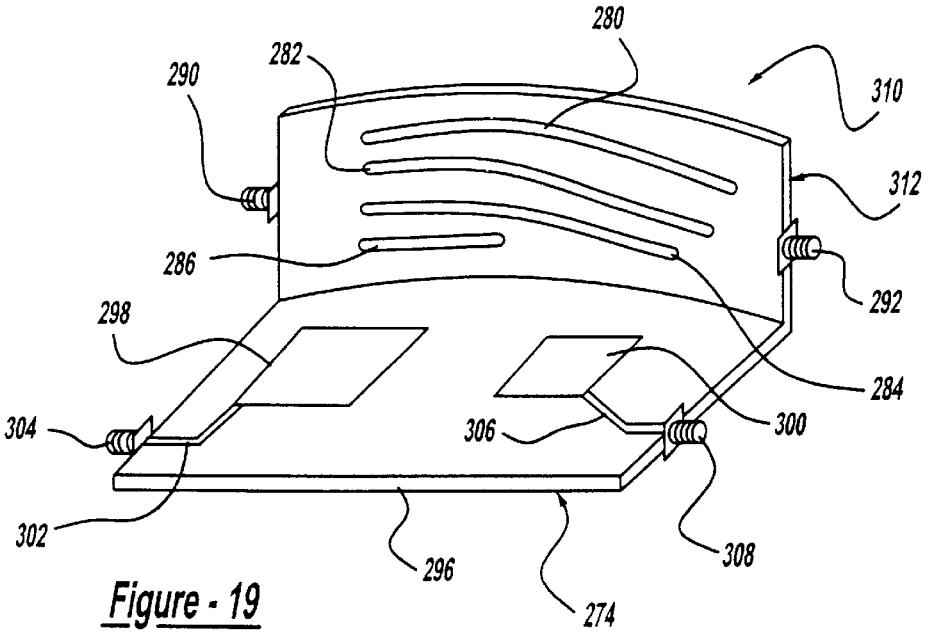
FIG. 19 is a perspective view of a variation of the antenna shown in FIG. 18 where the terrestrial radio, AMPS, GSM, PCS printed circuit board is curved relative to the GPS and satellite radio printed circuit board.

FIG. 19 is a perspective view of a multifunction antenna 310 similar to the antenna 270, where like components are identified by the same reference numeral. In this embodiment, the printed circuit board 272 is replaced with a printed circuit board 312 that is curved in a vertical direction. By slightly bending the PCB 312 in this manner, nulls along the edges of the PCB 312 are reduced, and a more omni-directional radiation pattern is achieved.

Figure 20:
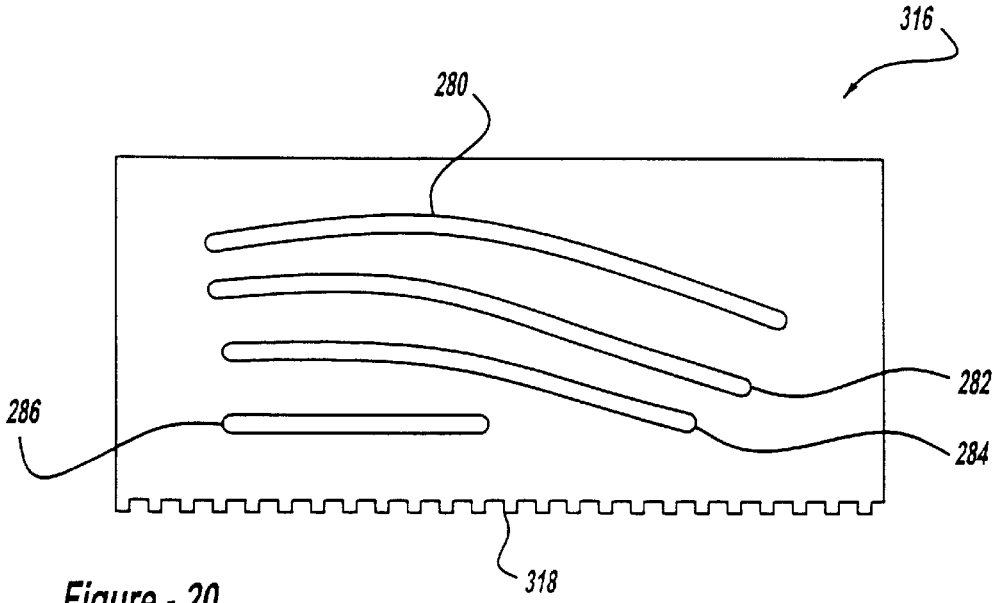
FIG. 20 is a front view of the terrestrial radio, AMPS, GSM and PCS printed circuit board of the antenna shown in FIGS. 18 and 19, where an edge of the printed circuit board has a saw tooth pattern to reduce edge currents.

FIG. 20 is a front view of a PCB 316 similar to the PCBs 272 and 312 where like reference numerals identify like components. In this embodiment, an edge 318 of the PCB 316 that would be mounted to the PCB 274 has a saw tooth pattern on the conductor to reduce edge currents between the PCBs 316 and 274. Reduction in edge currents minimizes adverse effects of the PCB 316 on the circular polarization of the patch elements 298 and 300.

Figure 21:
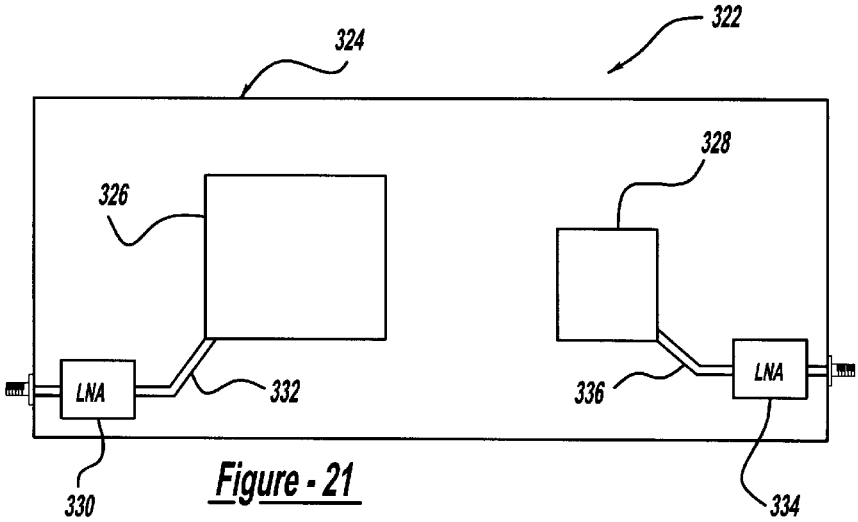
FIG. 21 is a front view of the GPS and satellite radio printed circuit board including low noise amplifiers, according to an embodiment of the present invention.

FIG. 21 is a front view of an antenna 322 including a PCB 324 on which is formed patch antenna elements 326 and 328 of the type discussed above. In this embodiment, a low noise amplifier (LNA) 330 is provided in a microstrip feed line 332 that feeds the antenna element 326. Further, an LNA 334 is provided in a microstrip feed line 336 that feeds the antenna element 328. Providing the LNAs 330 and 334 on the same circuit board as the antenna elements 326 and 328 provides better integration, lower cost and better performance. Low noise amplifiers can be configured on a common printed circuit board with the antenna elements 280–286, discussed above.

Figure 22:
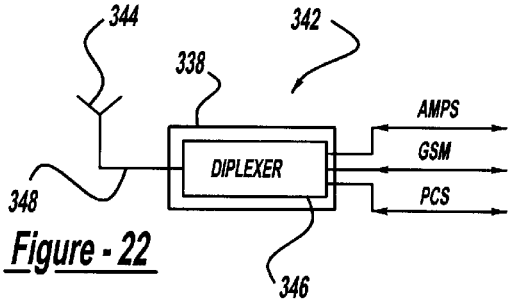
FIG. 22 is a schematic diagram of an antenna and diplexer configured on a common printed circuit board, according to an embodiment of the present invention.

Because various antenna elements are printed on a printed circuit board, the present invention proposes providing some of the necessary circuit elements on the circuit board to provide increased component integration, size reduction and noise performance. FIG. 22 is a schematic diagram of an antenna circuit 342 including an antenna 344 that is intended to represent each of the various AMPS, GSM and PCS slot antenna elements discussed herein. A diplexer 346 is mounted on a PCB 338, such as the same PCB as each of the AMPS, GSM and PCS slot antenna elements, for the purposes described herein. The diplexer 346 is coupled to a common feed line 348 or a feed distribution network that feeds all of the slot antenna elements. As is known in the art, the diplexer 346 acts as a filter to separate the received signals into the appropriate frequency band for AMPS, GSM and PCS signals. Also, because these services also require transmit functions, the diplexer 346 couples each of the AMPS, GSM and PCS signals onto the feed line 348 or a feed distribution network connected to the antennas.

Figure 23:
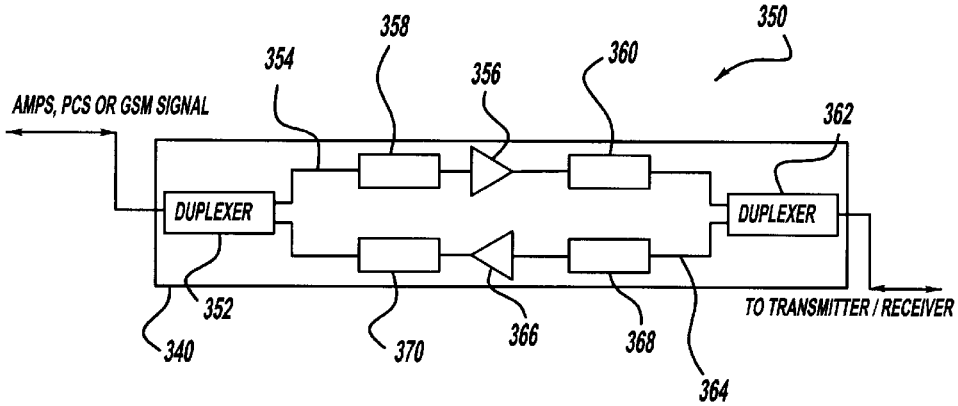
FIG. 23 is a schematic diagram of a receiver/transmitter amplifier circuit for a common printed circuit board, according to another embodiment of the present invention.

Other antenna circuit components can also be provided on the printed circuit board with the antenna elements. As discussed above, each of the AMPS, PCS and GSM signals require both transmit and receive signals. Because the transmit signals have much higher power levels than the receive signals, the receive and transmit circuits require components that handle different power levels, and so the signals must be separated. FIG. 23 is a schematic diagram of a receive/transmit amplifier circuit 350 formed on a printed circuit board 340 for this purpose. A separate receive/transmit circuit will be provided for each of the signals separated by the diplexer 346 discussed above. According to the invention, the rear bracket 34 includes a spring assembly 94 mounted to a rear surface 92 of the side plate 32 by a nut and bolt 96. As will be discussed in more detail below, the spring assembly 94 includes a pair of flat metal spring elements 98 and 100 that are positioned side by side and against each other, as shown. As is apparent, the spring element 100 is slightly longer than the spring element 98. The spring elements 98 and 100 extend relative to an opening 102 between the side plate 32 and the mounting portion 40. Thus, the spring elements 98 and 100 can flex in a direction perpendicular to the plane of the side plate 32 relative to the opening 102.

The receive signal from the diplexer 346 is sent to a duplexer 352. The duplexer 352 is a directional coupler that directs the signal into a particular path depending on its direction. The duplexer 352 couples the receive signal into a receive signal path 354 to be amplified by an amplifier 356. Filters 358 and 360 are provided in the path 354 to filter the signals that are not in the frequency band of interest to improve the signal-to-noise ratio. Signals to be transmitted by the antennas are sent to a duplexer 362 that couples the transmit signals into a transmit signal path 364. The signals in the transmit path 364 are amplified by a amplifier 366 and filtered by suitable filters 368 and 370. The amplification discussed herein is sometimes needed where the antenna is mounted interior to a platform, such as a vehicle interior. In this case, the signals are usually attenuated due to multi-path reflection or absorption in the surrounding environment.

The foregoing discussion discloses and describes merely exemplary embodiments of the present invention. One skilled in the art will readily recognize from such discussion, and from the accompanying drawings and claims, that various changes, modifications and variations can be made therein without departing from the spirit and scope of the invention as defined in the following claims.

What is claimed is:

1. A multifunction antenna comprising:

a printed circuit board having a first side and a second side;

a plurality of antenna elements formed on the first side of the printed circuit board;

a plurality of antenna elements formed on the second side of the printed circuit board; and a plurality of feed lines formed on the first side or second side of the printed circuit board, said feed lines providing feed signals for the plurality of antenna elements formed on the first and second side of the printed circuit board.

2. The antenna according to claim 1 wherein the plurality of antenna elements on the first side include a GPS antenna element and a satellite radio antenna element.

3. The antenna according to claim 2 wherein the GPS antenna element and the satellite radio antenna element are patch antenna elements.

4. The antenna according to claim 3 wherein one or both of the GPS antenna element and the satellite radio antenna element are corner fed patch antenna elements to provide a circularly polarized radiation pattern.

5. The antenna according to claim 3 wherein one or both of the GPS antenna element and the satellite radio antenna element are edge fed antenna elements where the plurality of feed lines include a first feed line electrically coupled to one side of the patch antenna element and a second feed line electrically coupled to an orthogonal side of the patch antenna element to provide a circularly polarized radiation pattern.

6. The antenna according to claim 1 wherein the plurality of antenna elements on the second side of the printed circuit board include a plurality of slot antenna elements patterned in a common ground plane.

7. The antenna according to claim 6 wherein each slot antenna element has a curved configuration.

8. The antenna according to claim 6 wherein each slot antenna element has a different length.

9. The antenna according to claim 6 wherein the plurality of slot antenna elements include an AMPS antenna element, a PCS antenna element, a GSM antenna element and terrestrial radio antenna element.

10. The antenna according to claim 6 wherein the plurality of feed hues include a microstrip feed line patterned on the first side of the printed circuit board and at least one shorting via electrically coupled to the ground plane, said microstrip feed line feeding the plurality of slot antenna elements.

11. The antenna according to claim 6 further comprising a diplexer mounted on the printed circuit board, said diplexer separating the signals received on a common feed line or feed distribution network from the plurality of slot antenna elements.

12. The antenna according to claim 6 wherein each of the plurality of slot antenna elements includes a receive/transmit circuit mounted on the printed circuit board, each receive/transmit circuit including electrical components for directionally coupling receive and transmit signals into separate receive and transmit paths, and an amplifier for amplifying the receive and transmit signals.

13. The antenna according to claim 1 further comprising at least one low noise amplifier mounted on the printed circuit board, said at least one amplifier being electrically coupled to at least one of the antenna elements.

14. The antenna according to claim 1 wherein the plurality of feed lines include a plurality of microstrip feed lines formed on the first side of the printed circuit board and a via extending through the printed circuit board, and wherein a plurality of the plurality of microstrip feed lines feed the plurality of antenna elements formed on the first side of the printed circuit board and at least one of the microstrip feed lines is coupled to the shorting via to feed the plurality of antenna elements on the second side of the printed circuit board.

15. A multifunction antenna comprising:

a printed circuit board having a first side and a second side;

a metallized ground plane patterned on the first side of the printed circuit board;

a plurality of slot antenna elements formed in the metallized ground plane; and a plurality of patch antenna elements formed on the second side of the printed circuit board.

16. The antenna according to claim 15 wherein each slot antenna element has a curved configuration.

17. The antenna according to claim 15 wherein each slot antenna element has a different length.

18. The antenna according to claim 15 wherein the plurality of slot antenna elements include an AMPS antenna element, a PCS antenna element, a GSM antenna element and terrestrial radio antenna element.

19. The antenna according to claim 15 wherein the plurality of patch antenna elements include a GPS antenna element and a satellite radio antenna element.

20. The antenna according to claim 15 wherein at least one of the patch antenna elements is a corner fed patch antenna element to provide a circularly polarized radiation pattern.

21. The antenna according to claim 15 wherein at least one of the patch antenna elements is an edge fed antenna element where a first feed line is electrically coupled to one side of the patch antenna element and a second feed line is electrically coupled to an orthogonal side of the patch antenna element to provide a circularly polarized radiation pattern.

22. The antenna according to claim 15 further comprising a microstrip feed line patterned on the second side of the printed circuit board and at least one shorting via electrically coupled to the ground plane, said microstrip feed line feeding the plurality of slot antenna elements.

23. The antenna according to claim 15 further comprising at least one low noise amplifier mounted on the printed circuit board, said at least one amplifier being electrically coupled to at least one of the antenna elements.

24. The antenna according to claim 15 further comprising a diplexer mounted on the printed circuit board, said diplexer separating the signals received on a common feed line or feed distribution network from the plurality of slot antenna elements.

25. The antenna according to claim 15 wherein each of the plurality of slot antenna elements includes a receive/transmit circuit mounted on the printed circuit board, each receive/transmit circuit including electrical components for directionally coupling receive and transmit signals into separate receive and transmit paths, and an amplifier for amplifying the receive and transmit signals.

26. A multifunction antenna comprising:

a first printed circuit board;

a second printed circuit board coupled to the first printed circuit board at an angle thereto;

a plurality of slot antenna elements configured on the first printed circuit board; and at least one antenna element configured on the second printed circuit board.

27. The antenna according to claim 26 wherein the plurality of slot antenna elements on the first printed circuit board and the antenna element on the second printed circuit board have different polarizations.

28. The antenna according to claim 26 wherein the plurality of slot antenna elements include an AMPS, GSM and PCS antenna element.

29. The antenna according to claim 26 wherein the at least one antenna element on the second printed circuit board is a plurality of patch antenna elements.

30. The antenna according to claim 29 wherein the plurality of patch antenna elements include a GPS antenna element and a satellite radio antenna element.

31. The antenna according to claim 26 wherein the first printed circuit board is curved relative to the second printed circuit board.

32. The antenna according to claim 31 wherein the first printed circuit board is curved in a vertical direction relative to the horizon.

33. The antenna according to claim 26 wherein an edge of the first printed circuit board that contacts the second printed circuit board is a saw tooth patterned edge.

34. The antenna according to claim 26 further comprising a diplexer mounted on the first printed circuit board, said diplexer separating the signals received on a common feed line or feed distribution network from the plurality of slot antenna elements.

35. The antenna according to claim 26 wherein each of the plurality of slot antenna elements includes a receive/transmit circuit mounted on the printed circuit board, each receive/transmit circuit including electrical components for directionally coupling receive and transmit signals into separate receive and transmit paths, and an amplifier for amplifying the receive and transmit signals.

36. The antenna according to claim 26 further comprising at least one low noise amplifier mounted on the first printed circuit board, said at least one amplifier being electrically coupled to the at least one of the plurality of slot antenna elements.

37. The antenna according to claim 26 wherein the first printed circuit board is vertically oriented and the second printed circuit board is horizontally oriented.

* * * * *

UNITED STATES PATENT AND TRADEMARK OFFICE

CERTIFICATE OF CORRECTION

PATENT NO. : 6,664,932 B2
DATED : December 16, 2003
INVENTOR(S) : Sabet et al.

It is certified that error appears in the above-identified patent and that said Letters Patent is hereby corrected as shown below:

Column 5,
Line 50, "5258" should be -- 52-58 --.

Column 12,
Line 39, "hues" should be -- lines --.

Column 14,
Line 46, "the" before "at least" should be deleted.

Signed and Sealed this

Twenty-sixth Day of July, 2005

JON W. DUDAS
*Director of the United States Patent and Trademark Office*